US006320313B1

(12) United States Patent
Yoo et al.

(10) Patent No.: US 6,320,313 B1
(45) Date of Patent: Nov. 20, 2001

(54) PLASMA DISPLAY PANEL WITH OPTICAL SHUTTER

(75) Inventors: Yeun Ho Yoo; Geun Soo Lim; Seong Hak Moon; Jeong Pil Choi; Hwan Yu Kim, all of Kyunggi-do (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 09/346,307

(22) Filed: Jul. 2, 1999

(30) Foreign Application Priority Data

Jul. 4, 1998 (KR) ..... 98-27029

(51) Int. Cl.[7] ..... H01J 17/49
(52) U.S. Cl. ..... 313/582; 313/586
(58) Field of Search ..... 313/582, 586, 313/605, 609, 610, 611, 634

(56) References Cited

FOREIGN PATENT DOCUMENTS 0 261 584 3/1988 (EP) .

*Primary Examiner*—Vip Patel
(74) *Attorney, Agent, or Firm*—Fleshner & Kim, LLP

(57) ABSTRACT

A plasma display panel with a bilateral display function that is adaptive for displaying a picture in two directions and a driving apparatus thereof are disclosed. In the plasma display panel, a first plasma display panel displays a picture by a discharge. A second plasma display panel is installed such that its display face is opposed to that of the first plasma display panel. An optical shutter is installed between the first and second plasma display panels to transmit or shut off lights incident thereto from the first and second plasma display panels.

2 Claims, 6 Drawing Sheets

PLASMA DISPLAY PANEL WITH OPTICAL SHUTTER

BACKGROUND OF THE INVENTION

1. Field of the Invention

This invention relates to a flat panel display device, and more particularly to a plasma display panel having a bilateral display function that is adaptive for displaying a picture in two directions and a driving apparatus thereof.

2. Description of the Related Art

Generally, a plasma display panel(PDP) radiates a fluorescent body by an ultraviolet with a wavelength of 147 nm generated during a discharge of He+Xe or Ne+Xe gas to thereby display a picture including characters and graphics. Such a PDP permits it to be easily made into a thin film and large-dimension type. Moreover, the PDP provides a very improved picture quality owing to a recent technical development. The PDP can be classified into an alternating current (AC) driving system making a surface discharge and a direct current (DC) driving system in accordance with its driving system.

Referring to FIG. 1, there is shown a PDP driving apparatus of AC system that includes a PDP 10 having a pixel matrix consisting of mxn discharge cells 1. In the PDP 10, m scanning/sustaining electrode lines Y1 to Ym, hereinafter referred to as "Y electrode lines", and m common sustaining electrode lines Z1 to Zm, hereinafter referred to as "Z electrode lines", are alternately formed, in parallel, on an upper glass substrate(not shown). Also, n address electrode lines X1 to Xn, hereinafter referred to as "X electrode line", are formed on a lower substrate(not shown) in a direction perpendicular to the Y electrode lines Y1 to Ym and the Z electrode lines Z1 to Zm. Each of the mxn discharge cells 1 is arranged in a matrix pattern at intersections among the Y electrode lines Y1 to Ym, the Z electrode lines Z1 to Zm and the address electrode lines X1 to Xn. A barrier rib(not shown) is formed on the lower substrate in parallel with X electrode lines X1 to Xn to divide the discharge cells 1 arranged at the vertical direction.

Further, the PDP driving apparatus of AC driving system includes first and second address drivers 6A and 6B connected to the X electrode lines X1 to Xn of the PDP 10, a scanning/sustaining driver 2 connected to the Y electrode lines Y1 to Ym of the PDP 10, and a common sustaining driver 4 connected to the Z electrode lines Z1 to Zm of the PDP 10. The first address driver 6A is connected to odd-numbered address electrode lines X1, X3, . . . , Xn−3, Xn−1 and the second address driver 6B is connected to even-numbered X electrodes X2, X4, . . . , Xn−2, Xn to apply a video data to each X electrode line X1 to Xn. The scanning/sustaining driver 2 is connected to m Y electrode lines Y1 to Ym to select a scanning line to be displayed and to cause a sustaining discharge at the displayed scanning line. The common sustaining driver 4 is commonly connected to m Z sustaining electrode lines Z1 to Zm to apply an identical waveform of voltage signal to all the Z electrode lines Z1 to Zm, thereby causing a sustaining discharge.

In such a PDP, one frame consists of a number of sub-fields, and a gray level is realized by a combination of the sub-fields. For instance, when it is intended to realize 256 gray levels, one frame interval is time-divided into 8 sub-fields. Further, each of the 8 sub-fields is again divided into an address interval and a sustaining interval. A discharge initiated at each of the discharge cells selected in the address interval is sustained during the sustaining interval. The sustaining interval is lengthened by an interval corresponding to $2^n$ depending on a weighting value of each sub-field. In other words, the sustaining interval involved in each of first to eighth sub-fields increases at a ratio of $2^0$, $2^1$, $2^3$, $2^4$, $2^5$, $2^6$ and $2^7$. To this end, the number of sustaining pulses generated in the sustaining interval also increases into $2^0$, $2^1$, $2^3$, $2^4$, $2^5$, $2^6$ and $2^7$ depending on the sub-fields. The brightness and the chrominance of a displayed image are determined in accordance with a combination of the sub-fields.

Since such a PDP has a wide view angle and favorable to making a large-scale screen, it can be used for a wall tapestry television as well as an advertising display device. In order to apply a PDP to the advertising display device, it is required to maximize an advertisement effect such as a double-faced display function and to improve the brightness.

SUMMARY OF THE INVENTION

Accordingly, it is an object of the present invention to provide a PDP with a bilateral display function that is suitable for displaying a picture in two directions, and a driving apparatus thereof.

Further object of the present invention is to provide a PDP with a bilateral display function that is capable of improving the brightness, and a driving apparatus thereof.

In order to achieve these and other objects of the invention, a plasma display panel with a bilateral display function according to one aspect of the present invention includes a first plasma display panel for displaying a picture by a discharge; a second plasma display panel, being installed in such a manner that its display face is opposed to that of the first plasma display panel for displaying a picture by a discharge; and an optical shutter member, being installed between the first and second plasma display panels, for transmitting or shutting off lights incident thereto from the first and second plasma display panels.

A driving apparatus for a plasma display panel with a bilateral display function according to another aspect of the present invention includes a display panel in which with an optical shutter member is installed between first and second plasma display panels for displaying a picture by a discharge; a memory controller for applying an input video signal for each of the first and second plasma display panels; panel driving means for driving the first and second display panels; optical shutter driving means for driving the optical shutter member; and control means for controlling the optical shutter driving means and the panel driving means.

BRIEF DESCRIPTION OF THE DRAWINGS

These and other objects of the invention will be apparent from the following detailed description of the embodiments of the present invention with reference to the accompanying drawings, in which.

DETAILED DESCRIPTION OF THE PREFERRED EMBODIMENT

Figure 1:
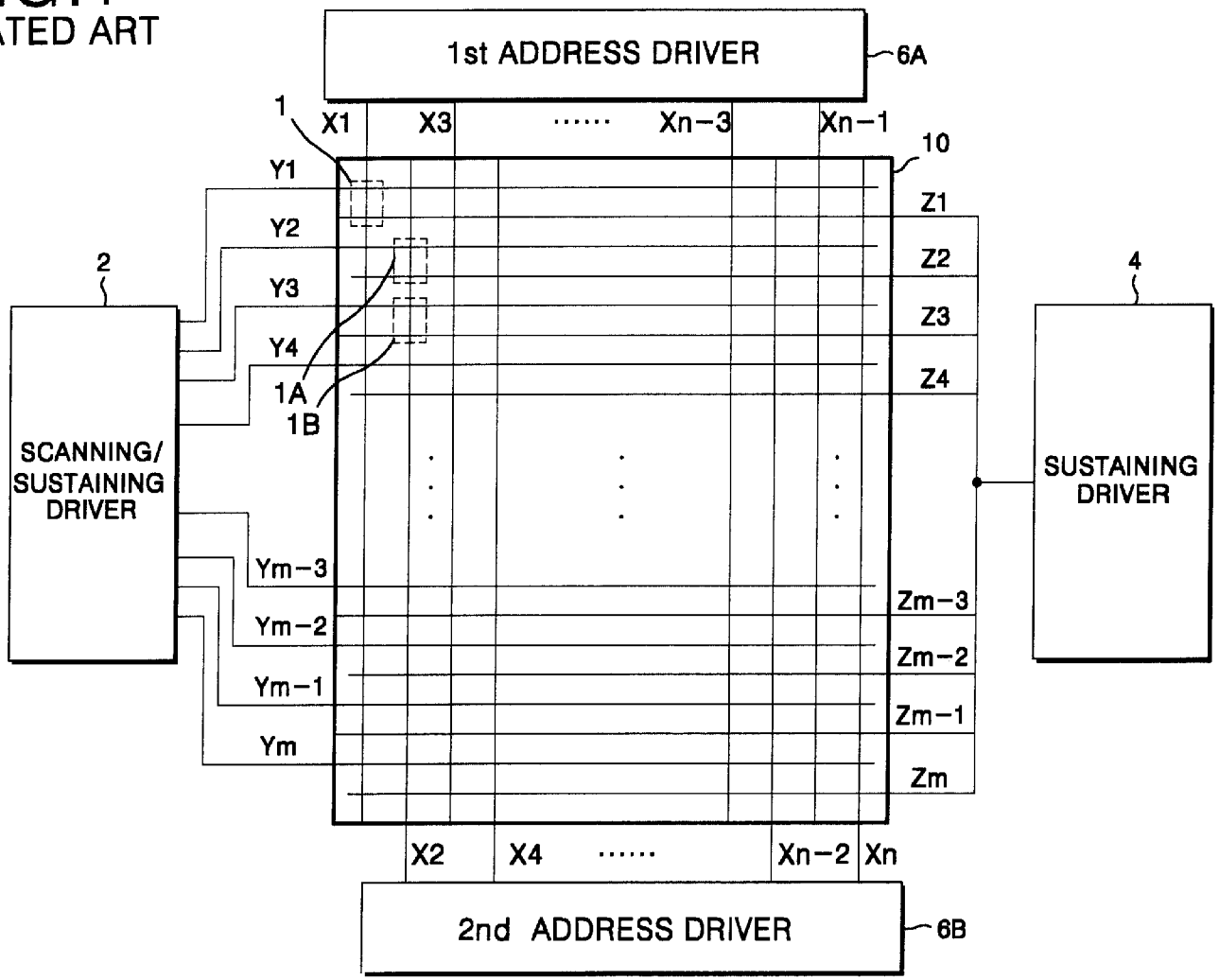
FIG. 1 RELATED ART
FIG. 1 is a schematic view showing the configuration of a conventional PDP driving apparatus of AC driving system.
Figure 2:
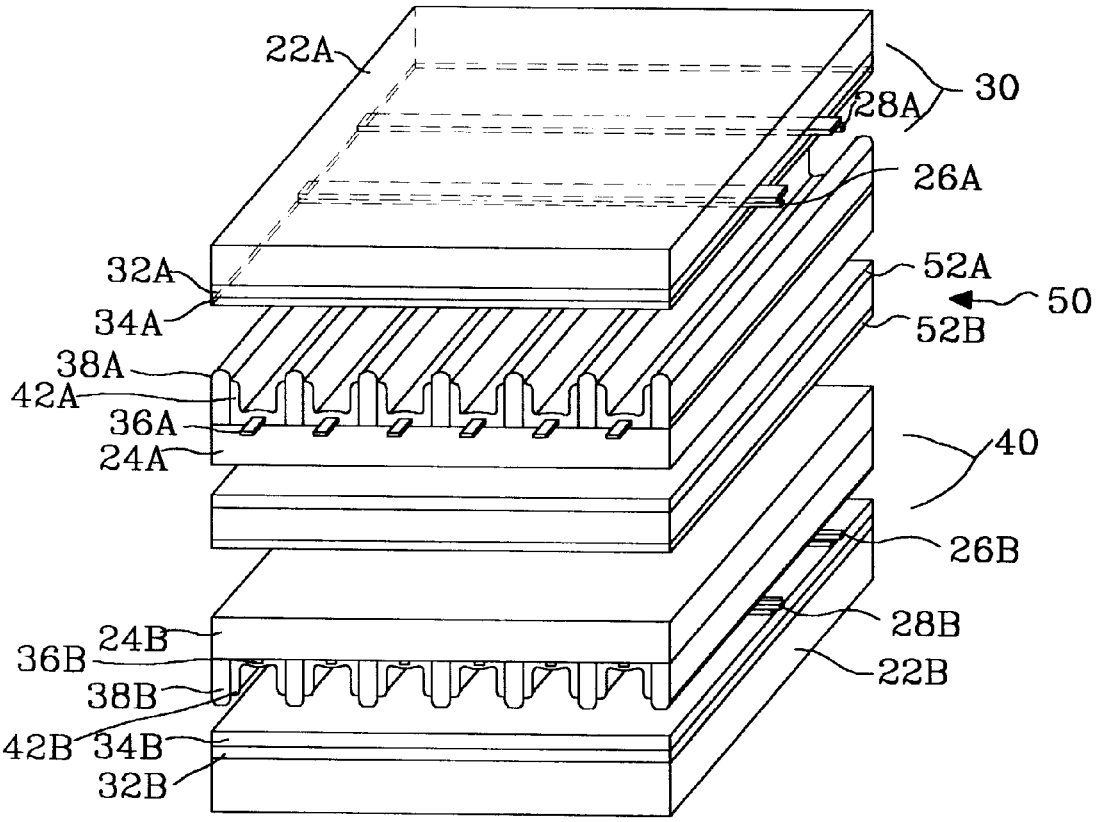
FIG. 2 is a perspective view showing the structure of a PDP with a bilateral display device according to an embodiment of the present invention.
Figure 3:
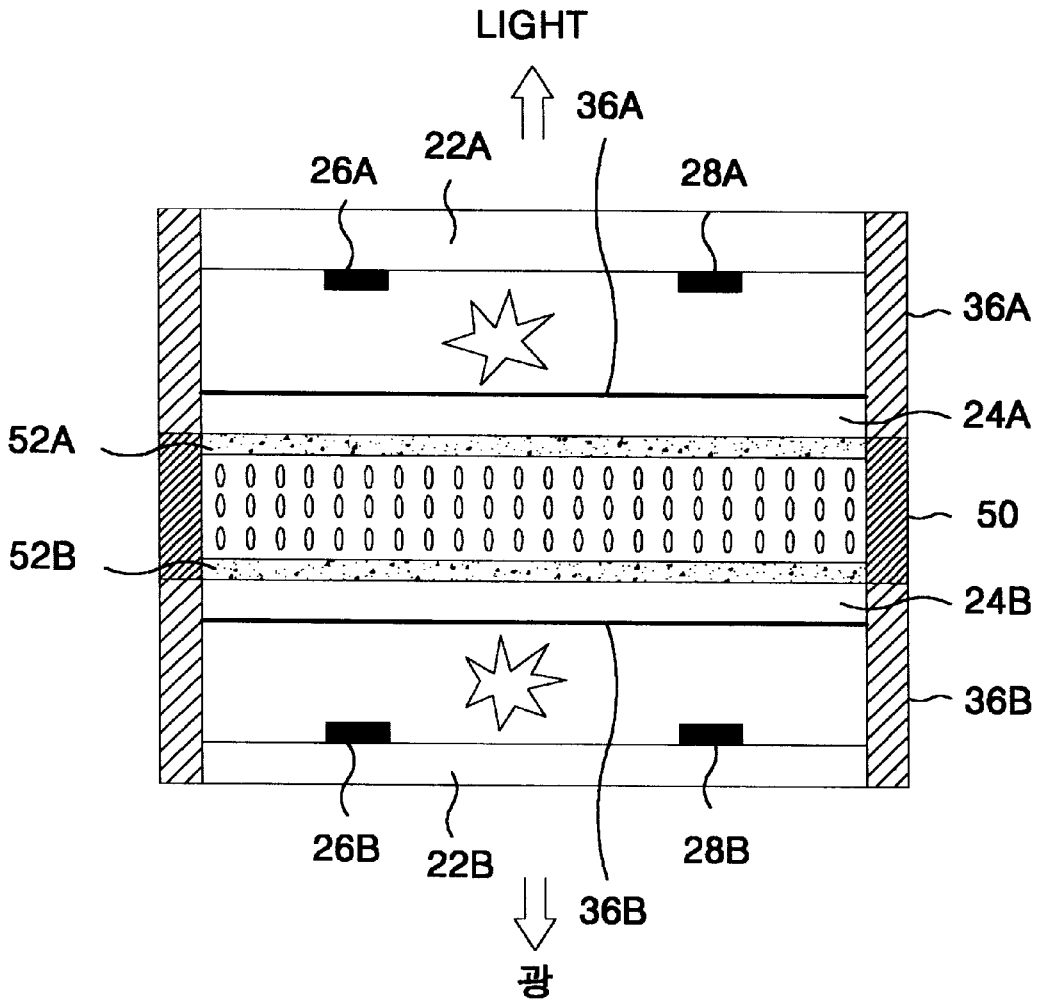
FIG. 3 is a longitudinal sectional view of the PDP with a bilateral display function shown in FIG. 2.

Referring to FIG. 2 and FIG. 3, there is shown a PDP with a bilateral display function according to an embodiment of the present invention. The PDP includes a front PDP 30, a rear PDP 40, and a liquid crystal filter 50 installed between the front PDP 30 and the rear PDP 40. The front PDP 30 includes an upper glass substrate 22A in which scanning/sustaining electrodes 26A, hereinafter referred to as "Y electrodes", and common sustaining electrodes 28A, hereinafter referred to as "Z electrodes", are formed in parallel, and a lower glass substrate 24A in which address electrodes 36A, hereinafter referred to as "X electrodes", is formed. The Y electrodes 26A are address-discharged along with the X electrodes 36A in an address interval and sustaining-discharged along with the Z electrodes 28A in a sustaining interval. A dielectric layer 32A and a protective film 34A are disposed on the upper glass substrate 22A, the Y electrodes 26A and the Z electrodes 28A. The dielectric layer 32A is responsible for accumulating a wall charge during the discharge, and the protective film 34A is responsible for protecting the dielectric layer 32A, the Y electrodes 26A and the Z electrodes 28A from a sputtering of charged particles generated by the discharge. On the lower glass substrate 24A, a barrier rib 38A is formed in parallel with the X electrodes 36A in the vertical direction. The barrier rib 38A plays a role to provide a discharge space along with the upper and lower glass substrates 22A and 24A as well as to prevent an optical cross talk between the adjacent discharge cells. A mixture gas such as Ne—Xe or He—Xe, etc. is injected into the discharge space. A fluorescent body 42 excited by an ultraviolet to be radiated is coated on the surface of the upper glass substrate 22B of the rear PDP 40. The rear PDP 40 is constructed in the same manner as the front PDP 30. Specifically, on an upper glass substrate 22B of the rear PDP 40, Y electrodes 26B and Z electrodes 28B are formed in parallel and a dielectric layer 32B and a protective film 34A are disposed. Further, on a lower substrate 24B of the rear PDP 40, X electrodes are formed in a direction perpendicular to the Y electrodes 26B and the Z electrodes 28B. Also, a barrier rib 38B is formed thereon and a fluorescent body 42A is coated thereon. A liquid crystal filter 50 has the inner side filled with a liquid crystal. Transparent electrodes 52A and 52B for applying an electric field to the liquid crystal are formed at the front side and the rear side of the liquid crystal filter 50.

Figure 4:
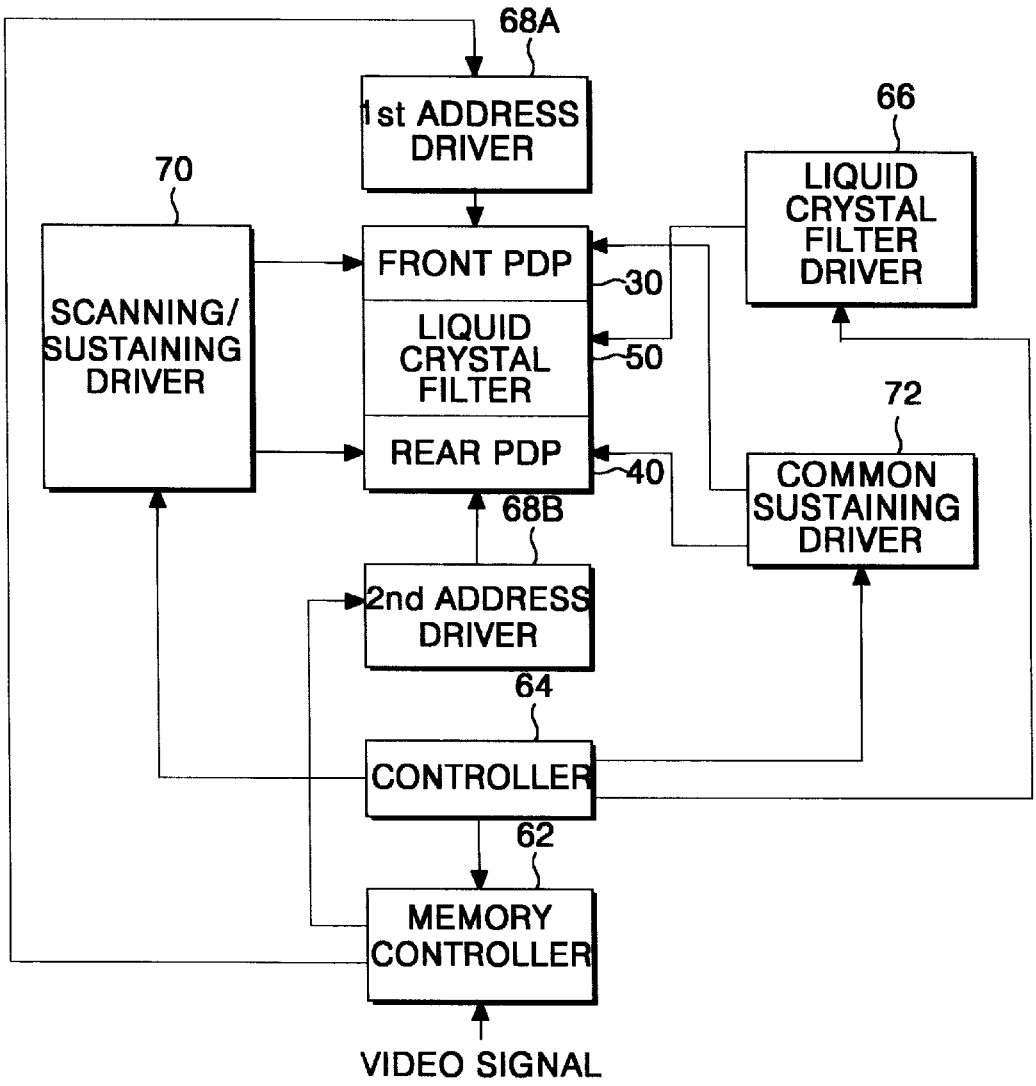
FIG. 4 is a block diagram showing the configuration of a driver for the PDP with a bilateral display function shown in FIG. 2.

FIG. 4 shows a driving apparatus for the PDP with a bilateral display function in FIG. 2. Referring to FIG. 2, the driving apparatus includes a memory controller 62 for separating a input video signal for each of the front PDP 30 and the rear PDP 40, a first address driver 68A for supplying a video data to X electrode lines X_front of the front PDP 30, a second address driver 68B for supplying a video data to X electrode lines X_rear of the rear PDP 40, a scanning/sustaining driver 70 for driving Y electrode lines Y_front and Y_rear of the front PDP 30 and the rear PDP 40, a common sustaining driver 72 for driving Z electrode lines Z_front and Z_rear of the front PDP 30 and the rear PDP 40, and a liquid crystal driver 66 for driving the liquid crystal filter 50. Further, the PDP driving apparatus includes a controller for controlling the scanning/sustaining driver 70, the common sustaining driver 72 and the liquid crystal filter driver 66. The memory controller 62 divides the input video signal for each of the front PDP 30 and the rear PDP 40 to store the divided video signals to the first and second address drivers 68A and 68B, and it divides the video signal for each frame and for each sub-field and stores the divided video signals. The video data stored in the memory controller 62 is divisionally supplied to the first and second address drivers 68A and 68B. The memory controller 62 is connected to the controller 64 to apply a timing signal such as a vertical synchronizing signal and a horizontal synchronizing signal and a mode identification signal having a different level value in accordance with a display mode. The memory controller 62 can supply different video data to each of the first and second address drivers 68A and 68B in such a manner that different pictures are displayed on each PDP 30 and 40 in the bilateral display mode. Otherwise, the memory controller 60 may supply the same video data to the first and second address drivers 68A and 68B in such a manner that the same picture is displayed on each PDP 30 and 40 in the bilateral display mode. The controller 64 controls the scanning/sustaining driver 70 and the common sustaining driver 72 in accordance with the timing signal and the mode identification signal applied from the memory controller 62. The controller 64 controls a liquid crystal filter driver 66 in accordance with the mode identification signal from the memory controller 62. The scanning/sustaining driver 70 applies a scanning pulse to the Y electrode lines Y_front and Y_rear of each PDP 30 and 40 in the address interval and applies a sustaining pulse thereto in the sustaining interval under control of the controller 64. The common sustaining driver 72 applies a sustaining pulse to the Z electrode lines Z_front and Z_rear of each PDP 30 and 40 in the sustaining interval under control of the controller 64. The liquid crystal filter driver 66 is connected to the transparent electrodes 52A and 52B of the liquid crystal filter 50 to apply a liquid crystal control signal Cliq having a different level value to the liquid crystal filter 66 in accordance with the bilateral display mode and the unilateral display mode. In the bilateral display mode, the liquid crystal filter driver 66 applies a low-level liquid crystal control signal Cliq to the liquid crystal filter 50 under control of the controller 64. Otherwise, in the unilateral display mode, the liquid crystal filter driver 66 applies a liquid crystal control signal Cliq maintaining a high level in the sustaining interval to the liquid crystal filter 50 under control of the controller 64.

Figure 5:
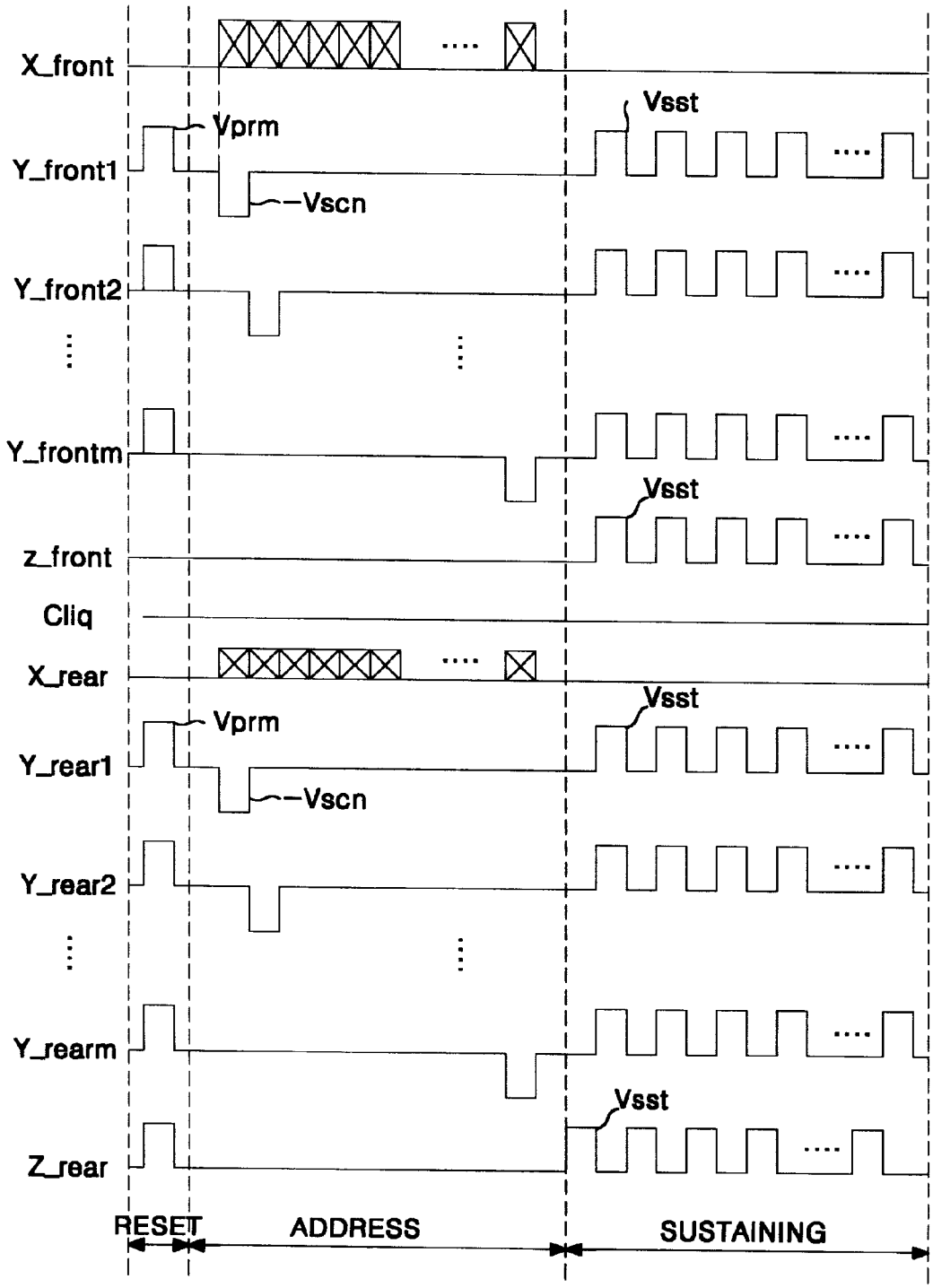
FIG. 5 is waveform diagrams of driving signals for making a bilateral display of the PDP with a bilateral display function shown in FIG. 2.

FIG. 5 is waveform diagrams of driving signals for making a bilateral display of the PDP with a bilateral display function shown in FIG. 2. In FIG. 5, in the reset interval, a positive polarity(+) of reset pulse Vprm is applied to the entire Y electrode lines Y_front and Y_rear of each PDP 30 and 40. By this reset pulse, a priming discharge occurs to produce a wall charge uniformly within the entire discharge space. The wall charge produced in the reset interval lowers a driving voltage during the address discharge. In the address interval, a negative polarity(−) of scanning pulse −Vscan synchronized with a video data is sequentially applied to the Y electrode lines Y_front and Y_rear of each PDP 30 and 40. At this time, since an address discharge is generated between the X electrode lines X_front and X_rear by a voltage difference between the video data and the scanning pulse −Vscan, the video data is sequentially written into the m scanning lines. Herein, the video data supplied to each PDP 30 and 40 may be same and different. In the sustaining interval, a sustaining pulse Vsus is applied to the Y electrode lines Y_front and Y_rear and the Z electrode lines Z_front and Z_rear of each PDP 30 and 40. At the same time, the low-level liquid crystal control signal Cliq is applied to the liquid crystal filter 50. A sustaining discharge is generated between the Y electrode lines Y_front and Y_rear and the z electrode lines Z_front and Z_rear by a sustaining pulse Vsst. At this time, an ultraviolet generated by the discharge excites fluorescent bodies 42A and 42B. After the fluorescent bodies 42A and 42B are excited, they are transited to emit visible rays. The liquid crystals within the liquid crystal filter 50 have an arrangement direction changed in the horizontal direction by the low level liquid crystal control signal Cliq applied to the transparent electrodes 52A and 52B. Accordingly, the liquid crystal filter 50 shuts off a light incident thereto from each PDP 30 and 40. Each PDP 30 and 40 displays the same pictures or different pictures depending on a video data applied to the X electrode lines X_front and X_rear.

Figure 6:
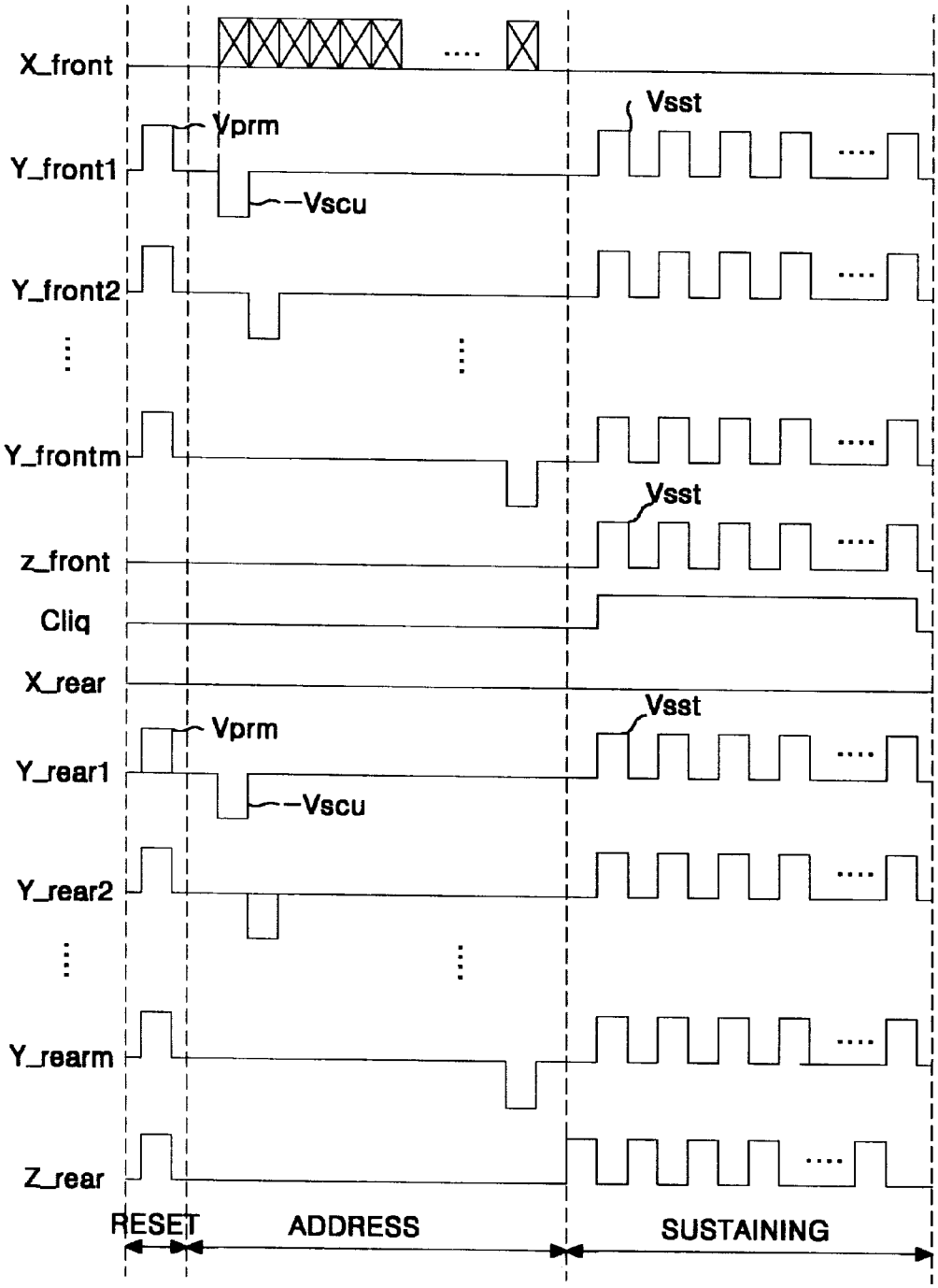
FIG. 6 is waveform diagrams of driving signals for making a unilateral display function shown in FIG. 2.

FIG. 6 is waveform diagrams of driving signals for making a unilateral display of the PDP with a bilateral display function shown in FIG. 2, which are driving waveforms when only the front PDP 30 displays a picture. Referring to FIG. 6, in the reset interval, a positive polarity (+) of reset pulse Vprm is applied to the entire Y electrode lines Y_front and Y_rear of each PDP 30 and 40. By this reset pulse Vprm, a priming discharge is generated to generate a wall charge uniformly within the entire discharge space. In the address interval, a negative polarity(−) of scanning pulse −Vscn synchronized with the video data is sequentially applied to the Y electrode lines Y_front and Y_rear of each PDP 30 and 40. At this time, since an address discharge is generated between the X electrode lines X_front and the Y electrode lines Y_front of the front PDP 30 by a voltage difference between the video data and the scanning pulse −Vscn, the video data is sequentially written into the scanning lines of the front PDP 30. On the other hand, since a video data is not supplied to the X electrode lines X_rear of the rear PDP 40, an address discharge is not generated at the rear PDP 40. In the sustaining interval, a sustaining pulse Vsus is applied to the Y electrode lines Y_front and Y_rear and the Z electrode lines Z_front and Z_rear of each PDP 30 and 40. At the same time, a high-level liquid crystal control signal Cliq is applied to the liquid crystal filter 50. A sustaining discharge is generated between the Y electrode lines Y_front and Y_rear and the Z electrode lines Z_front and Z_rear of each PDP 30 and 40 by the sustaining pulse Vsst. The liquid crystals within the liquid crystal filter 50 has an arrangement direction changed in the vertical direction by the high-level liquid crystal control signal Cliq applied to the transparent electrodes 52A and 52B. The liquid crystal filter 50 transmits a light incident thereto from the rear PDP 40 into the front PDP 30. Accordingly, a picture displayed on the front PDP 30 has a high brightness.

Meanwhile, in the PDP with a bilateral display function according to the present invention, the liquid crystal filter 50 serves as an optical shutter for transmitting or shutting off a light in accordance with the bilateral display mode and the unilateral display mode, so that it may be replaced by a different optical shutter controlled electrically.

As described above, the PDP with a bilateral display function according to the present invention is provided with a liquid crystal filter for transmitting or shutting off a light between the two PDPs, and displays the same pictures or different pictures simultaneously on the two PDPs in the bilateral display mode. On the other hand, in the PDP with a bilateral display function according to the present invention displays, any one of the two PDPs displays a picture while the other one thereof serves as a back light, thereby improving the brightness of a picture.

Although the present invention has been explained by the embodiments shown in the drawings described above, it should be understood to the ordinary skilled person in the art that the invention is not limited to the embodiments, but rather that various changes or modifications thereof are possible without departing from the spirit of the invention. Accordingly, the scope of the invention shall be determined only by the appended claims and their equivalents.

What is claimed is:

1. A plasma display panel with a bilateral display function, comprising:

a first plasma display panel for displaying a picture by a discharge;

a second plasma display panel, being installed in such a manner that its display face is opposed to that of the first plasma display panel for displaying a picture by a discharge; and an optical shutter member, being installed between the first and second plasma display panels, for transmitting or shutting off lights incident thereto from the first and second plasma display panels.

2. The plasma display panel as claimed in claim 1, wherein said optical shutter member includes a liquid crystal having an arrangement direction changed by an electric field applied thereto.

* * * * *